US008715794B2

(12) United States Patent
Araki et al.

(10) Patent No.: US 8,715,794 B2
(45) Date of Patent: May 6, 2014

(54) RECORDING MEDIUM

(71) Applicant: Canon Kabushiki Kaisha, Tokyo (JP)

(72) Inventors: Kazuhiko Araki, Kawasaki (JP); Yasuhiro Nito, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/926,868

(22) Filed: Jun. 25, 2013

(65) Prior Publication Data

US 2014/0004281 A1 Jan. 2, 2014

(30) Foreign Application Priority Data

Jun. 28, 2012 (JP) ..... 2012-145661

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5218* (2013.01); *B41M 5/52* (2013.01); *B41M 5/506* (2013.01); *B41M 5/504* (2013.01)

USPC ..... 428/32.21; 428/32.22; 428/32.31

(58) Field of Classification Search

CPC ..... B41M 5/5218; B41M 5/52; B41M 5/506; B41M 5/504

USPC ..... 428/32.21, 32.22, 32.31

See application file for complete search history.

(56) References Cited

U.S. PATENT DOCUMENTS

| | | | | |
|---|---|---|---|---|
| 5,002,825 | A * | 3/1991 | Mimura et al. | 428/315.5 |
| 2002/0025413 | A1* | 2/2002 | Ohbayashi et al. | 428/195 |
| 2007/0231511 | A1* | 10/2007 | Okuda et al. | 428/32.34 |
| 2011/0300316 | A1* | 12/2011 | Tanaka et al. | 428/32.31 |

FOREIGN PATENT DOCUMENTS

| | | | |
|---|---|---|---|
| JP | 61-10483 | A | 1/1986 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2006-240287 | A | 9/2006 |

* cited by examiner

*Primary Examiner* — Betelhem Shewareged

(74) *Attorney, Agent, or Firm* — Canon U.S.A., Inc., IP Division

(57) ABSTRACT

A recording medium includes a base paper, a polymer layer disposed on the base paper, and an ink-receiving layer disposed on the polymer layer. The base paper has a thickness of 50 μm or more and 130 μm or less. The polymer layer has a thickness of 20 μm or more and 60 μm or less. The polymer layer has an arithmetic average surface roughness $Ra_1$ of 0.12 μm or more and 0.18 μm or less. The polymer layer has a roughness curve element average length RSm of 0.01 mm or more and 0.20 mm or less. The recording medium has an arithmetic average surface roughness $Ra_2$ of 0.13 μm or less.

6 Claims, 1 Drawing Sheet

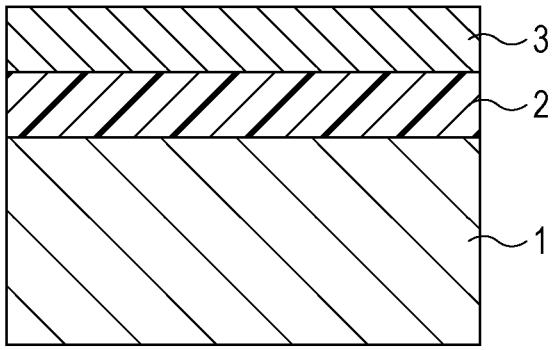
3
2
1

RECORDING MEDIUM

BACKGROUND OF THE INVENTION

1. Field of the Invention

The present invention relates to a recording medium.

2. Description of the Related Art

Recording media on which images can be given the feel of a silver halide photograph are commercially available. The recording media include a base paper coated with a polymer. It is known that base papers coated with a polymer have higher glossiness and water fastness than base papers alone and can prevent or reduce cockling. Japanese Patent Laid-Open No. 2006-240287 discloses that the surface smoothness of a base paper coated with a polymer can be improved to manufacture a high-gloss recording medium.

There is an increasing demand for photo books and photo albums. Characteristics required for recording media for use in photo books and photo albums include image quality similar to that of silver halide photography, turnability, and opacity, which is a property of preventing an image on the back side from being seen through the front side in duplex recording. Images on a recording medium that includes a base paper coated with a polymer and an ink-receiving layer can be given the feel of a silver halide photograph. Thus, such a recording medium can be used for photo books and photo albums. The present inventors have studied a method for improving turnability and opacity of a recording medium that includes a base paper coated with a polymer and an ink-receiving layer.

In general, a method for improving the turnability of a recording medium may be a method for decreasing the rigidity of the recording medium to facilitate the deformation of the recording medium when the recording medium is turned over. In order to decrease the rigidity of the recording medium without reducing ink absorbency, the thickness of the base paper coated with a polymer may be reduced. However, a decrease in the thickness of the polymer layer may impair the degree to which the texture of the recording medium is similar to the texture of photographic paper, and recorded images cannot have the feel of silver halide photograph. A decrease in the thickness of the base paper may cause deformation or breakage of the base paper in a process of winding the base paper, resulting in poor winding of the base paper.

The present inventors found that a decrease in the thickness of the polymer-coated base paper of the recording medium described in Japanese Patent Laid-Open No. 2006-240287 so as to improve turnability resulted in poor winding of the base paper. This also resulted in high transparency of the recording medium, and an image on the back side was sometimes visible through the front side.

SUMMARY OF THE INVENTION

The present invention provides a recording medium for images having the feel of silver halide photography. The recording medium has high turnability. An image on the back side of the recording medium is rarely visible through the front side in duplex recording. A substrate of the recording medium is easy to wind.

Such a recording medium can be provided by the present invention. A recording medium according to an aspect of the present invention includes a base paper, a polymer layer disposed on the base paper, and an ink-receiving layer disposed on the polymer layer. The base paper has a thickness of 50 μm or more and 130 μm or less. The polymer layer has a thickness of 20 μm or more and 60 μm or less. The polymer layer has an arithmetic average surface roughness $Ra_1$ of 0.12 μm or more and 0.18 μm or less in accordance with JIS B 0601:2001. The polymer layer has a roughness curve element average length RSm of 0.01 mm or more and 0.20 mm or less in accordance with JIS B 0601:2001. The recording medium has an arithmetic average surface roughness $Ra_e$ of 0.13 μm or less in accordance with JIS B 0601:2001.

The present invention can provide a recording medium for images having the feel of silver halide photography. The recording medium has high turnability. An image on the back side of the recording medium is rarely visible through the front side in duplex recording. A substrate of the recording medium is easy to wind.

Further features of the present invention will become apparent from the following description of exemplary embodiments with reference to the attached drawing.

BRIEF DESCRIPTION OF THE DRAWING

FIGURE is a schematic view of a recording medium according to an embodiment of the present invention.

DESCRIPTION OF THE EMBODIMENTS

The present invention will be described in detail in the following embodiments.

As a result of extensive studies, the present inventors found that in order to provide images having the feel of silver halide photography and high turnability the arithmetic average surface roughness of a recording medium must be as low as 0.13 μm or less in accordance with JIS B 0601:2001 (hereinafter referred to as $Ra_2$), a base paper of the recording medium must have a thickness of 50 μm or more and 130 μm or less, and a polymer layer disposed on the base paper (hereinafter also referred to as a "polymer-coated substrate") must have a thickness of 20 μm or more and 60 μm or less.

However, only satisfying these conditions sometimes resulted in low opacity, and an image on the back side could be seen through the front side in duplex recording. Furthermore, the substrate was difficult to wind, and deformation or breakage of the substrate could occur in a process of winding the substrate.

The present inventors first studied a method for improving the surface smoothness of a polymer-coated substrate as in a known recording medium described in Japanese Patent Laid-Open No. 2006-240287. However, it was difficult to prevent an image on the back side from being seen through the front side or improve the winding of the substrate. Thus, the present inventors increased the surface roughness of a polymer-coated substrate and found that this can prevent an image on the back side from being seen through the front side and improve the winding of the substrate. Although there is no clear reason for this, the present inventors believe the reason as described below.

First, it is supposed that an image on the back side is visible through the front side because the recording medium has high optical transparency. However, a decrease in the optical transparency of the ink-receiving layer results in poor color developability of an image. Thus, the present inventors studied a method for reducing the optical transparency of the substrate and found that the surface smoothness of a polymer-coated substrate can be reduced to cause the reflection of light at an interface between an ink-receiving layer and the substrate, thereby preventing an image on the back side from being seen through the front side while maintaining the color developability of the image.

One of the reasons for deformation or breakage of the substrate in a process of winding the substrate is the inclusion of air during winding. An increase in the surface roughness of the polymer-coated substrate or roughening of the surface of the polymer-coated substrate allows air inclusions to escape and thereby reduces deformation or breakage of the substrate.

On the basis of these findings, the present inventors have studied the surface state of a polymer-coated substrate to improve the opacity and winding of the substrate without affecting the quality of images and turnability. The present inventors found that a polymer layer on a surface of the substrate must have an arithmetic average surface roughness (hereinafter referred to as $Ra_1$) of 0.12 μm or more and 0.18 μm or less in accordance with JIS B 0601:2001 and a roughness curve element average length (hereinafter referred to as RSm) of 0.01 mm or more and 0.20 mm or less in accordance with JIS B 0601:2001.

Thus, these constituents can synergistically produce their effects to achieve the advantages of the present invention.

[Recording Medium]

A recording medium according to an embodiment of the present invention includes a base paper, a polymer layer disposed on the base paper, and an ink-receiving layer disposed on the polymer layer. One exemplary structure of a recording medium according to an embodiment of the present invention will be described below with reference to the accompanying drawing. The recording medium illustrated in the FIGURE includes a base paper 1, a polymer layer 2, and an ink-receiving layer 3. The recording medium may further include another layer between the base paper 1 and the polymer layer 2, between the polymer layer 2 and the ink-receiving layer 3, or on the ink-receiving layer 3, without losing the advantages of the present invention. The base paper 1, the polymer layer 2, and the ink-receiving layer 3 are preferably stacked in this order. A recording medium according to an embodiment of the present invention may be an ink jet recording medium for use in an ink jet recording method.

In an embodiment of the present invention, the recording medium has an arithmetic average surface roughness $Ra_2$ of 0.13 μm or less in accordance with JIS B 0601:2001. When the recording medium has $Ra_2$ of more than 0.13 μm, images having the feel of silver halide photography may not be obtained. $Ra_2$ is preferably 0.05 μm or more, more preferably 0.10 μm or more. The arithmetic average surface roughness of the recording medium may be controlled by pressing a surface of the polymer-coated substrate with an uneven roller and applying a coating liquid for an ink-receiving layer to the surface or by pressing a surface of the recording medium with an uneven roller.

In an embodiment of the present invention, the recording medium has an opacity of 97% or more in accordance with JIS P 8149:2000. The components of a recording medium according to an embodiment of the present invention will be described below.

<Polymer-Coated Substrate>

In an embodiment of the present invention, the polymer-coated substrate includes a base paper and a polymer layer, and the base paper is coated with the polymer layer. The polymer layer must be disposed on a surface of the base paper on which an ink-receiving layer is to be formed. The polymer layer may be disposed on one or both sides of the base paper. The polymer layer may cover part of the surface of the base paper. The coverage by the polymer layer (the area of a surface of the base paper coated with the polymer layer/the entire surface area of the base paper) is preferably 70% or more, more preferably 90% or more, particularly preferably 100%; that is, the entire surface of the base paper is particularly preferably coated with the polymer layer. The components of the polymer-coated substrate will be described below.

Base Paper

In an embodiment of the present invention, the base paper has a thickness of 50 μm or more and 130 μm or less. The base paper preferably has a thickness of 90 μm or more and 120 μm or less. When the base paper has a thickness of 130 μm or less, the recording medium becomes more flexible and has improved turnability. When the base paper has a thickness of less than 50 μm, the recording medium may have too little strength to turn over and may have low opacity; therefore an image on the back side may be seen through the front side in duplex recording. In an embodiment of the present invention, the thickness of the base paper is calculated by the following method. First, a recording medium is cut with a microtome, and the cross section is observed with a scanning electron microscope. The thickness measurements at 100 or more points are averaged to determine the thickness of the base paper. The thickness of another layer in an embodiment of the present invention is also determined in the same manner.

In an embodiment of the present invention, the base paper preferably has a density of 0.6 $g/cm^3$ or more and 1.2 $g/cm^3$ or less, more preferably 0.7 $g/cm^3$ or more and 1.2 $g/cm^3$ or less, in accordance with JIS P 8118.

The base paper is mainly made of wood pulp. If necessary, the base paper is made of wood pulp and synthetic pulp, such as polypropylene pulp, or synthetic fibers, such as nylon or polyester fibers. Examples of the wood pulp include, but are not limited to, leaf bleached kraft pulp (LBKP), leaf bleached sulfite pulp (LBSP), needle bleached kraft pulp (NBKP), needle bleached sulfite pulp (NBSP), leaf dissolving pulp (LDP), needle dissolving pulp (NDP), leaf unbleached kraft pulp (LUKP), and needle unbleached kraft pulp (NUKP). These may be used alone or in combination. The wood pulp may be LBKP, NBSP, LBSP, NDP, or LDP, which contains a large amount of short fiber component. The pulp may be chemical pulp (sulfate pulp or sulfite pulp) containing less impurities. The pulp may be bleached to increase the degree of whiteness. The base paper may contain a sizing agent, a white pigment, a paper strengthening agent, a fluorescent brightener, a water-retaining agent, a dispersant, and/or a softening agent.

Polymer Layer

In an embodiment of the present invention, the polymer layer has a thickness of 20 μm or more and 60 μm or less. The polymer layer preferably has a thickness of 35 μm or more and 50 μm or less. The polymer layers on both sides of the base paper may have the thickness described above. When the polymer layer has a thickness of 20 μm or more, the recording medium has a texture similar to the texture of photographic paper, and images recorded on the recording medium have the feel of silver halide photography. The polymer layer having a thickness of more than 60 μm may be too rigid to turn over the recording medium.

The polymer layer may be made of a thermoplastic polymer. Examples of the thermoplastic polymer include, but are not limited to, acrylic polymers, acrylic silicone polymers, polyolefin polymers, and styrene-butadiene copolymers. Among these, the thermoplastic polymer may be a polyolefin polymer. The term "polyolefin polymer", as used herein, refers to a polymer of an olefin monomer. More specifically, the polyolefin polymer may be a homopolymer or a copolymer of ethylene, propylene, and/or isobutylene. These polyolefin polymers may be used alone or in combination. Among these, the polyolefin polymer may be polyethylene. The polyethylene may be a low-density polyethylene (LDPE) or a high-density polyethylene (HDPE).

In an embodiment of the present invention, the polymer layer may contain a white pigment, a fluorescent brightener, and/or an ultramarine blue pigment to control its opacity, degree of whiteness, or hue. In particular, the polymer layer may contain a white pigment to improve its opacity. Examples of the white pigment include, but are not limited to, rutile and anatase titanium oxides. In an embodiment of the present invention, the white pigment content of the polymer layer may be 3 $g/m^2$ or more and 30 $g/m^2$ or less. For polymer layers disposed on both sides of the base paper, the total white pigment content of the two polymer layers may be in the range described above. The white pigment content of the polymer layer may be 25% by mass or less of the polymer content. A white pigment content of more than 25% by mass may result in insufficient dispersion stability of the white pigment.

In an embodiment of the present invention, the polymer layer has an arithmetic average surface roughness $Ra_1$ of 0.12 μm or more and 0.18 μm or less, preferably 0.13 μm or more and 0.15 μm or less, in accordance with JIS B 0601:2001. For polymer layers disposed on both sides, at least the polymer layer on which an ink-receiving layer is to be formed has $Ra_1$ in the range described above. $Ra_1$ of less than 0.12 μm may result in deformation or breakage of the substrate in a process of winding the substrate, resulting in poor winding of the substrate. $Ra_1$ of more than 0.18 μm may result in a rougher surface of the recording medium, and recorded images may not be given the feel of a silver halide photograph. The arithmetic average surface roughness of a polymer layer may be controlled by pressing a surface of the polymer-coated substrate with an uneven roller.

In an embodiment of the present invention, the arithmetic average surface roughness $Ra_1$ of the polymer layer may be greater than the arithmetic average surface roughness $Ra_2$ of recording medium ($Ra_1 > Ra_2$). The difference $\Delta Ra$ ($Ra_1 - Ra_2$) between the arithmetic average surface roughness $Ra_1$ of the polymer layer and the arithmetic average surface roughness $Ra_2$ of the recording medium may be 0.03 μm or more and 0.05 μm or less. $\Delta Ra$ of 0.03 μm or more results in further improved image quality. $\Delta Ra$ of 0.05 μm or less results in further improved turnability of the recording medium.

In an embodiment of the present invention, the polymer layer has a roughness curve element average length RSm of 0.01 mm or more and 0.20 mm or less, preferably 0.04 mm or more and 0.15 mm or less, in accordance with JIS B 0601:2001. For polymer layers disposed on both sides, at least the polymer layer on which an ink-receiving layer is to be formed has RSm in the range described above. RSm outside this range may result in deformation or breakage of the substrate in a process of winding the substrate, resulting in poor winding of the substrate.

<Ink-Receiving Layer>

In an embodiment of the present invention, the polymer layer on the polymer-coated substrate is covered with an ink-receiving layer. The ink-receiving layer may be disposed on both sides of the polymer-coated substrate. The ink-receiving layer may have a thickness of 15 μm or more and 60 μm or less. Materials for the ink-receiving layer will be described below.

Inorganic Particles

In an embodiment of the present invention, the ink-receiving layer may contain inorganic particles. The inorganic particles preferably have an average primary particle size of 50 nm or less, more preferably 1 nm or more and 30 nm or less, particularly preferably 3 nm or more and 10 nm or less. In an embodiment of the present invention, the average primary particle size of inorganic particles is the number average diameter of circles each having an area equal to the projected area of the corresponding primary particle of the inorganic particles in electron microscope observation. The measurement is performed at 100 or more points.

In an embodiment of the present invention, inorganic particles dispersed using a dispersant may be used in a coating liquid for the ink-receiving layer. The dispersed inorganic particles preferably has an average secondary particle size of 0.1 nm or more and 500 nm or less, more preferably 1.0 nm or more and 300 nm or less, particularly preferably 10 nm or more and 250 nm or less. The average secondary particle size of dispersed inorganic particles can be measured by a dynamic light scattering method.

In an embodiment of the present invention, the inorganic particle content (% by mass) of the ink-receiving layer is preferably 50% by mass or more and 98% by mass or less, more preferably 70% by mass or more and 96% by mass or less.

In an embodiment of the present invention, the coating weight ($g/m^2$) of the inorganic particles in the formation of the ink-receiving layer may be 8 $g/m^2$ or more and 45 $g/m^2$ or less. Within this range, the ink-receiving layer may have a desired film thickness.

Examples of the inorganic particles for use in an embodiment of the present invention include, but are not limited to, alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide, and zirconium hydroxide particles. These inorganic particles may be used alone or in combination. Among these inorganic particles, alumina hydrate, alumina, and silica particles can form a porous structure having high ink absorbency.

Alumina hydrate for use in the ink-receiving layer may have a general formula (X): $Al_2O_{3-n}(OH)_{2n}.mH_2O$ (wherein n denotes 0, 1, 2, or 3, and m denotes 0 or more and 10 or less, preferably 0 or more and 5 or less, provided that m or n is not 0). In many instances, $mH_2O$ means a detachable aqueous phase not involved in the formation of a crystal lattice, and therefore m may not be an integer. When alumina hydrate is heated, m may be 0.

In an embodiment of the present invention, alumina hydrate may be produced by a known method. More specifically, alumina hydrate may be produced by hydrolyzing an aluminum alkoxide, hydrolyzing sodium aluminate, or neutralizing an aqueous sodium aluminate solution with an aqueous aluminum sulfate or aluminum chloride solution.

It is known that alumina hydrate has a crystal structure of amorphous, gibbsite, or boehmite, depending on the heat treatment temperature. The crystal structure of alumina hydrate can be analyzed by an X-ray diffraction method. In an embodiment of the present invention, among these, boehmite or amorphous alumina hydrate may be used. Specific examples of alumina hydrate include, but are not limited to, alumina hydrates described in Japanese Patent Laid-Open No. 7-232473, No. 8-132731, No. 9-66664, and No. 9-76628 and commercial products Disperal HP14 and HP18 (manufactured by Sasol). These alumina hydrates may be used alone or in combination.

In an embodiment of the present invention, alumina hydrate preferably has a BET specific surface area of 100 $m^2/g$ or more and 200 $m^2/g$ or less, more preferably 125 $m^2/g$ or more and 175 $m^2/g$ or less. The BET specific surface area is determined from the number of molecules or ions having a known size adsorbed on the surface of a sample. In an embodiment of the present invention, a gas to be adsorbed on the surface of a sample is nitrogen gas.

Alumina for use in the ink-receiving layer may be gas-phase alumina. Examples of the gas-phase alumina include, but are not limited to, γ-alumina, α-alumina, δ-alumina, θ-alumina, and χ-alumina. Among these, γ-alumina can provide high image optical density and ink absorbency. Specific examples of the gas-phase alumina include, but are not limited to, Aeroxide Alu C, Alu 130, and Alu 65 (manufactured by Evonik Industries AG.).

In an embodiment of the present invention, the gas-phase alumina preferably has a BET specific surface area of 50 $m^2/g$ or more, more preferably 80 $m^2/g$ or more, and preferably 150 $m^2/g$ or less, more preferably 120 $m^2/g$ or less.

The gas-phase alumina preferably has an average primary particle size of 5 nm or more, more preferably 11 nm or more, and preferably 30 nm or less, more preferably 15 nm or less.

Alumina hydrate and alumina for use in an embodiment of the present invention may be mixed in the form of aqueous dispersion with a coating liquid for the ink-receiving layer using an acid dispersant. The acid dispersant may be a sulfonic acid having a general formula (Y): R—$SO_3H$ (wherein R denotes a hydrogen atom, an alkyl group having 1 or more and 4 or less carbon atoms, or an alkenyl group having 1 or more and 4 or less carbon atoms. R may be substituted with an oxo group, a halogen atom, an alkoxy group, and/or an acyl group). Such a sulfonic acid can suppress blurring of images. In an embodiment of the present invention, the acid content is preferably 1.0% by mass or more and 2.0% by mass or less, more preferably 1.3% by mass or more and 1.6% by mass or less, of the total alumina hydrate and alumina content.

Silica for use in the ink-receiving layer is broadly divided into wet silica and dry (gas-phase) silica in accordance with its production method. In accordance with one known wet process, a silicate is decomposed with an acid to form activated silica, and the activated silica is subjected to polymerization, coagulation, and sedimentation to yield hydrous silica. In accordance with one known dry process (gas-phase process), anhydrous silica is produced by high-temperature gas phase hydrolysis (flame hydrolysis) of a silicon halide or thermal reduction and vaporization of silica sand and coke with an arc in an electric furnace and oxidization with air (an arc process). In an embodiment of the present invention, silica produced by a dry process (gas-phase process) (hereinafter referred to also as "gas-phase silica") may be used. Gas-phase silica has a particularly large specific surface area, particularly high ink absorbency, and a low refractive index. Thus, gas-phase silica can impart transparency and high color developability to the ink-receiving layer. Specific examples of the gas-phase silica include, but are not limited to, Aerosil (manufactured by Nippon Aerosil Co., Ltd.) and Reolosil QS (manufactured by Tokuyama Corp.).

In an embodiment of the present invention, the gas-phase silica preferably has a BET specific surface area of 50 $m^2/g$ or more and 400 $m^2/g$ or less, more preferably 200 $m^2/g$ or more and 350 $m^2/g$ or less.

In an embodiment of the present invention, gas-phase silica dispersed using a dispersant may be used in a coating liquid for the ink-receiving layer. The dispersed gas-phase silica may have a particle size of 50 nm or more and 300 nm or less. The particle size of dispersed gas-phase silica can be measured by a dynamic light scattering method.

In an embodiment of the present invention, alumina hydrate, alumina, and silica may be used in combination. More specifically, at least two selected from alumina hydrate, alumina, and silica powders may be mixed and dispersed to produce a dispersion liquid. In an embodiment of the present invention, the inorganic particles may be alumina hydrate and gas-phase alumina. The ratio of the alumina hydrate content (% by mass) to the gas-phase alumina content (% by mass) in the outermost surface layer of the ink-receiving layer may be 60/40 or more and 90/10 or less, that is, 1.5 or more and 9.0 or less.

Binder

In an embodiment of the present invention, the ink-receiving layer may contain a binder. The term "binder", as used herein, refers to a material that can bind inorganic particles together to form a film.

In an embodiment of the present invention, the binder content of the ink-receiving layer is preferably 50% by mass or less, more preferably 30% by mass or less, of the inorganic particle content in terms of ink absorbency. The binder content of the ink-receiving layer is preferably 5.0% by mass or more, more preferably 8.0% by mass or more, of the inorganic particle content in terms of the binding of the ink-receiving layer.

Examples of the binder include, but are not limited to, starch derivatives, such as oxidized starch, etherified starch, and phosphorylated starch; cellulose derivatives, such as carboxymethylcellulose and hydroxyethylcellulose; casein, gelatin, soybean protein, poly(vinyl alcohol), and derivatives thereof; latexes of conjugated polymers, such as polyvinylpyrrolidone, maleic anhydride polymers, styrene-butadiene copolymers, and methyl methacrylate-butadiene copolymers; latexes of acrylic polymers, such as acrylate and methacrylate polymers; latexes of vinyl polymers, such as ethylene-vinyl acetate copolymers; latexes of functional-group-modified polymers, such as the polymers described above modified with a monomer having a functional group, such as a carboxy group; the polymers described above cationized using a cation group; the polymers described above having a surface cationized using a cation surfactant; the polymers described above having a surface on which cationic poly(vinyl alcohol) is distributed by the polymerization of monomers constituting the polymers in the presence of the cationic poly(vinyl alcohol); the polymers described above having a surface on which cationic colloidal particles are distributed by the polymerization of monomers constituting the polymers in a suspension of the cationic colloidal particles; aqueous binders, such as thermosetting synthetic polymers, such as melamine polymers and urea polymers; polymers and copolymers of acrylates and methacrylates, such as poly(methyl methacrylate); and synthetic polymers, such as polyurethane polymers, unsaturated polyester polymers, vinyl chloride-vinyl acetate copolymers, poly(vinyl butyral), and alkyd polymers. These binders may be used alone or in combination.

Among these binders, poly(vinyl alcohol) and poly(vinyl alcohol) derivatives may be used. Examples of the poly(vinyl alcohol) derivatives include, but are not limited to, cation-modified poly(vinyl alcohol), anion-modified poly(vinyl alcohol), silanol-modified poly(vinyl alcohol), and poly(vinyl acetal). The cation-modified poly(vinyl alcohol) may be poly(vinyl alcohol) having a primary, secondary, or tertiary amino group or a quaternary ammonium group in its main chain or side chain, as described in Japanese Patent Laid-Open No. 61-10483.

Poly(vinyl alcohol) may be synthesized by saponification of poly(vinyl acetate). The degree of saponification of poly (vinyl alcohol) is preferably 80% by mole or more and 100% by mole or less, more preferably 85% by mole or more and 98% by mole or less. The degree of saponification is the rate of the number of moles of hydroxy groups produced by saponification of poly(vinyl acetate) to produce poly(vinyl alcohol). In an embodiment of the present invention, the degree of saponification is determined in accordance with JIS K 6726. Poly(vinyl alcohol) preferably has an average degree of polymerization of 2,000 or more, more preferably 2,000 or more and 5,000 or less. In an embodiment of the present invention, the average degree of polymerization is a viscosity-average degree of polymerization determined in accordance with JIS K 6726.

A coating liquid for the ink-receiving layer may be prepared using an aqueous poly(vinyl alcohol) or poly(vinyl alcohol) derivative solution. The solid content of the aqueous poly(vinyl alcohol) or poly(vinyl alcohol) derivative solution may be 3% by mass or more and 20% by mass or less.

Cross-Linker

In an embodiment of the present invention, the ink-receiving layer may further contain a cross-linker. Examples of the cross-linker include, but are not limited to, aldehyde compounds, melamine compounds, isocyanate compounds, zirconium compounds, amide compounds, aluminum compounds, boric acids, and borates. These cross-linkers may be used alone or in combination. In particular, when the binder is poly(vinyl alcohol) or a poly(vinyl alcohol) derivative, among these cross-linkers, boric acid or a borate may be used.

Examples of boric acids include, but are not limited to, orthoboric acid ($H_3BO_3$), metaboric acid, and hypoboric acid. Borates may be water-soluble salts of these boric acids. Examples of such borates include, but are not limited to, alkali metal salts of boric acid, such as sodium borate and potassium borate, alkaline-earth metal salts of boric acid, such as magnesium borate and calcium borate, and ammonium salts of boric acid. Among these, orthoboric acid can improve the temporal stability of a coating liquid and reduce the occurrence of cracks.

The amount of cross-linker used depends on the manufacturing conditions. In an embodiment of the present invention, the cross-linker content of the ink-receiving layer is preferably 1.0% by mass or more and 50% by mass or less, more preferably 5% by mass or more and 40% by mass or less, of the binder content.

When the binder is poly(vinyl alcohol) and when the cross-linker is at least one selected from boric acids and borates, the total boric acid and borate content may be 5% by mass or more and 30% by mass or less of the poly(vinyl alcohol) content of the ink-receiving layer.

Other Additive Agents

In an embodiment of the present invention, the ink-receiving layer may contain other additive agents. Specific examples of other additive agents include, but are not limited to, a pH-adjusting agent, a thickener, a flow modifier, an antifoaming agent, a foam inhibitor, a surfactant, a mold-release agent, a penetrant, a color pigment, a color dye, a fluorescent brightener, an ultraviolet absorber, an antioxidant, a preservative, a fungicide, a water resistance improver, a dye fixative, a curing agent, and a weatherproofer.

<Undercoat Layer>

In an embodiment of the present invention, in order to improve the adhesion between the polymer-coated substrate and the ink-receiving layer, an undercoat layer may be disposed between the polymer-coated substrate and the ink-receiving layer. The undercoat layer may contain a water-soluble polyester polymer, gelatin, or poly(vinyl alcohol). The undercoat layer may have a thickness of 0.01 μm or more and 5 μm or less.

<Back Coat Layer>

In an embodiment of the present invention, a back coat layer may be disposed on a surface of the polymer-coated substrate opposite the ink-receiving layer in order to improve handleability, transportability, and scratch resistance during transport in continuous printing of a plurality of recording media. The back coat layer may contain a white pigment and a binder. The back coat layer may have a thickness such that the dry coating weight is 1 $g/m^2$ or more and 25 $g/m^2$ or less.

[Method for Manufacturing Recording Medium]

In an embodiment of the present invention, a method for manufacturing a recording medium is not particularly limited and may include a process of manufacturing a polymer-coated substrate and applying a coating liquid for an ink-receiving layer to the polymer-coated substrate. A method for manufacturing a recording medium will be described below.

<Method for Manufacturing Polymer-Coated Substrate>

In an embodiment of the present invention, a method for manufacturing a base paper may be a common paper-making method. Examples of a paper-making apparatus include, but are not limited to, a Fourdrinier machine, a cylinder machine, a drum paper machine, and a twin-wire former. In order to improve the surface smoothness of a base paper, heat and pressure may be applied to the base paper to perform surface treatment during or after the paper-making process. A specific surface treatment method may be calendering, such as machine calendering or supercalendering.

A method for forming a polymer layer on a base paper or a method for coating a base paper with a polymer may be a melt extrusion process, wet lamination, or dry lamination. In the melt extrusion process, one or both sides of a base paper may be coated with molten polymer by extrusion coating. For example, a transported base paper and a polymer from an extrusion die are pressed between a nip roller and a cooling roller to form a polymer layer on the base paper (also referred to as an extrusion coating process). The extrusion coating process is widely employed. In the formation of a polymer layer by the melt extrusion process, pretreatment may be performed to improve adhesion between a base paper and the polymer layer. The pretreatment may be acid etching using a mixture of sulfuric acid and chromic acid, flame treatment using gas flame, ultraviolet irradiation treatment, corona discharge treatment, glow discharge treatment, or anchor coating treatment using an alkyl titanate. Among these, corona discharge treatment may be used. When the polymer layer contains a white pigment, the base paper may be coated with a mixture of a polymer and the white pigment.

The arithmetic average surface roughness $Ra_1$ and the roughness curve element average length RSm of the polymer layer may be controlled by pressing the polymer layer with an uneven roller. More specifically, the polymer layer may be subjected to an embossing calender, or the polymer may be applied to the base paper while its surface is pressed and cooled with an uneven cooling roller. The latter method can form more precise and uniform asperities at a lower pressure.

The polymer-coated substrate thus manufactured may be wound around a core before the formation of the ink-receiving layer. The core may have a diameter of 50 mm or more and 300 mm or less. The polymer-coated substrate may be wound at a tension of 50 N/m or more and 800 N/m or less. The tension may be constant from the beginning to the end. In order to reduce pressure concentration in the beginning, the tension may be gradually reduced from the beginning to the end.

<Method for Forming Ink-Receiving Layer>

An ink-receiving layer of a recording medium according to an embodiment of the present invention may be formed on a polymer-coated substrate by the following method. First, a coating liquid for the ink-receiving layer is prepared. The coating liquid is applied to the polymer-coated substrate and is dried to produce a recording medium. The coating liquid may be applied with a curtain coater, an extrusion coater, or a slide hopper coater. The coating liquid may be heated during the application. The coating liquid may be dried using a hot-air dryer, such as a linear tunnel dryer, an arch dryer, an air loop dryer, or a sine-curve air float dryer, or an infrared, heating, or microwave dryer.

EXAMPLES

The present invention will be further described in the following examples and comparative examples. However, the present invention is not limited to these examples. Unless otherwise specified, "part" in the following examples is based on mass.

[Manufacture of Recording Medium]

<Manufacture of Polymer-Coated Substrate>

Manufacture of Base Paper

Water was added to a mixture of 80 parts of LBKP having a Canadian Standard freeness of 450 mL CSF, 20 parts of NBKP having a Canadian Standard freeness of 480 mL CSF, 0.60 parts of cationized starch, 10 parts of heavy calcium carbonate, 15 parts of light calcium carbonate, 0.10 parts of an alkyl ketene dimer, and 0.030 parts of cationic polyacrylamide such that the solid content was 3.0% by mass to prepare stuff. The stuff was then subjected to a Fourdrinier machine and a three-stage wet press and was dried with a multi-cylinder dryer. The resulting paper was impregnated with an aqueous solution of oxidized starch using a size press machine such that the solid content after drying was 1.0 g/m$^2$. After drying, the paper was subjected to machine calendering to produce a base paper A. The base paper A had a basis weight of 105 g/m$^2$ and a thickness of 105 μm. Base papers B to G having different thicknesses were also manufactured in the same manner. Table 2 listed the thicknesses of the base papers A to G.

Preparation of Polymer Composition

A low-density polyethylene and titanium oxide were mixed at a ratio listed in Table 1 to prepare a polymer composition.

TABLE 1

(unit: % by mass)

| Polymer composition | | |
|---|---|---|
| Polymer composition No. | Low density polyethylene | Titanium oxide |
| Polymer composition P1 | 85.0 | 15.0 |
| Polymer composition P2 | 73.7 | 26.3 |
| Polymer composition P3 | 89.5 | 10.5 |
| Polymer composition P4 | 91.2 | 8.8 |
| Polymer composition P5 | 96.4 | 3.6 |
| Polymer composition P6 | 95.7 | 4.3 |
| Polymer composition P7 | 75.0 | 25.0 |
| Polymer composition P8 | 65.0 | 35.0 |
| Polymer composition P9 | 91.9 | 8.1 |
| Polymer composition P10 | 73.3 | 26.7 |

Manufacture of Polymer-Coated Substrate

A polymer composition melted at 320° C. was applied to a base paper by a melt extrusion process and was pressed with a cooling drum. The surface property of the cooling drum was changed to produce polymer-coated substrates having different degrees of arithmetic average surface roughness $Ra_1$ and different roughness curve element average lengths RSm. Table 2 lists a combination of the base paper and the polymer composition, the total white pigment content of the polymer layer (g/m$^2$), and the thickness (μm), $Ra_1$ (μm), and RSm (mm) of the polymer layer. The arithmetic average surface roughness $Ra_1$ and the roughness curve element average length RSm of the polymer-coated substrate were measured with a surface roughness measuring instrument Surfcorder SE3500 (manufactured by Kosaka Laboratory Ltd.) in accordance with JIS B 0601:2001.

TABLE 2

| Structure of Polymer-Coated Substrate | | | | | | | |
|---|---|---|---|---|---|---|---|
| | Base paper | | Polymer layer | | | $Ra_1$ | RSm of polymer |
| Polymer-coated substrate No. | Type of base paper | Thickness (μm) | Type of polymer composition | Total white pigment content (g/m$^2$) | Thickness (μm) | of polymer layer (μm) | layer (mm) |
| Polymer-coated substrate 1 | Base paper A | 105 | Polymer composition P1 | 10.5 | 35 | 0.15 | 0.04 |
| Polymer-coated substrate 2 | Base paper B | 50 | Polymer composition P1 | 10.5 | 35 | 0.18 | 0.04 |
| Polymer-coated substrate 3 | Base paper C | 90 | Polymer composition P1 | 10.5 | 35 | 0.15 | 0.04 |
| Polymer-coated substrate 4 | Base paper D | 120 | Polymer composition P1 | 10.5 | 35 | 0.15 | 0.04 |
| Polymer-coated substrate 5 | Base paper E | 130 | Polymer composition P1 | 10.5 | 35 | 0.14 | 0.04 |
| Polymer-coated substrate 6 | Base paper A | 105 | Polymer composition P2 | 10.5 | 20 | 0.18 | 0.04 |
| Polymer-coated substrate 7 | Base paper A | 105 | Polymer composition P3 | 10.5 | 35 | 0.14 | 0.04 |
| Polymer-coated substrate 8 | Base paper A | 105 | Polymer composition P4 | 10.5 | 60 | 0.13 | 0.04 |
| Polymer-coated substrate 9 | Base paper A | 105 | Polymer composition P5 | 2.5 | 35 | 0.15 | 0.04 |
| Polymer-coated substrate 10 | Base paper A | 105 | Polymer composition P6 | 3.0 | 35 | 0.15 | 0.04 |
| Polymer-coated substrate 11 | Base paper A | 105 | Polymer composition P7 | 30.0 | 60 | 0.13 | 0.04 |
| Polymer-coated substrate 12 | Base paper A | 105 | Polymer composition P1 | 10.5 | 35 | 0.12 | 0.04 |
| Polymer-coated substrate 13 | Base paper A | 105 | Polymer composition P1 | 10.5 | 35 | 0.18 | 0.04 |
| Polymer-coated substrate 14 | Base paper A | 105 | Polymer composition P1 | 10.5 | 35 | 0.15 | 0.01 |
| Polymer-coated substrate 15 | Base paper A | 105 | Polymer composition P1 | 10.5 | 35 | 0.15 | 0.15 |
| Polymer-coated substrate 16 | Base paper A | 105 | Polymer composition P1 | 10.5 | 35 | 0.15 | 0.20 |
| Polymer-coated substrate 17 | Base paper F | 40 | Polymer composition P1 | 10.5 | 35 | 0.19 | 0.04 |
| Polymer-coated substrate 18 | Base paper G | 140 | Polymer composition P1 | 10.5 | 35 | 0.14 | 0.04 |
| Polymer-coated substrate 19 | Base paper A | 105 | Polymer composition P8 | 10.5 | 15 | 0.19 | 0.04 |
| Polymer-coated substrate 20 | Base paper A | 105 | Polymer composition P9 | 10.5 | 65 | 0.13 | 0.04 |
| Polymer-coated substrate 21 | Base paper A | 105 | Polymer composition P1 | 10.5 | 35 | 0.11 | 0.04 |
| Polymer-coated substrate 22 | Base paper A | 105 | Polymer composition P1 | 10.5 | 35 | 0.15 | 0.001 |
| Polymer-coated substrate 23 | Base paper A | 105 | Polymer composition P1 | 10.5 | 35 | 0.15 | 0.30 |
| Polymer-coated substrate 24 | Base paper A | 105 | Polymer composition P1 | 10.5 | 35 | 0.11 | 0.40 |
| Polymer-coated substrate 25 | Base paper A | 105 | Polymer composition P10 | 32.0 | 60 | — | — |

The white pigment in the polymer layer of the polymer-coated substrate 25 in the table had low dispersion stability, and the polymer layer had a rough surface. Thus, the surface properties could not be measured. The polymer layer had an uneven thickness with an average of 60 μm.

[Evaluation of Polymer-Coated Substrate]

Winding of Substrate

The polymer-coated substrate thus manufactured was wound around a core having a diameter of 150 mm at a tension of 750 N/m at a rate of 100 m/min. The tension was constant from the beginning to the end. The winding properties of the wound substrate (roll) was visually evaluated. The evaluation criteria were as described below. In these evaluation criteria, A and B were acceptable, and C and D were unacceptable. Table 4 shows the evaluation results.

A: Little deformation was observed on the surface of the roll, and irregularities were not observed at the ends of the roll.

B: Although little deformation was observed on the surface of the roll, some irregularities were observed at the ends of the roll.

C: Slight deformation was observed on the surface of the roll, and irregularities were observed at the ends of the roll.

D: Deformation was observed on the surface of the roll, and significant irregularities were observed at the ends of the roll.

<Preparation of Coating Liquid for Ink-Receiving Layer>

100 parts of alumina hydrate Disperal HP14 (manufactured by Sasol) was gradually added to an aqueous solution of 1.5 parts of methanesulfonic acid in 333 parts of ion-exchanged water while stirring with a homomixer T.K. HOMO MIXER MARK II 2.5 (manufactured by Tokushu Kika Kogyo Co., Ltd.) at 3000 rpm. After the addition, the solution was stirred for another 30 minutes to prepare an alumina hydrate dispersion liquid having a solid content of 23% by mass.

Water was added to a mixture of 441 parts of the alumina hydrate dispersion liquid, 125 parts of an aqueous poly(vinyl alcohol) solution (PVA 235 (manufactured by Kuraray Co., Ltd.) having a degree of polymerization of 3,500 and a degree of saponification of 88% by mole, solid content 8% by mass), and 20 parts of an aqueous orthoboric acid solution (solid content 5% by mass) such that the solid content was 18% by mass. A surfactant Surfynol 465 was added to the mixture such that the surfactant constituted 0.1% by mass of the mixture. Thus, a coating liquid for an ink-receiving layer was prepared.

<Manufacture of Recording Medium>

The coating liquid for an ink-receiving layer was applied to each surface (first surface) of the polymer-coated substrates 1 to 24 on which the polymer layer was disposed and the opposite surface (second surface) on which the polymer layer was not disposed. The coating liquid was dried with hot air at a temperature of 100° C. at a wind velocity of 10 m/s. Thus, a recording medium was manufactured. Table 3 listed the type of the polymer-coated substrate, the thickness of the ink-receiving layer on the first surface (μm), the arithmetic average surface roughness $Ra_2$ of the recording medium on the first surface side (μm), ΔRa (μm), and the opacity of the recording medium (%). The arithmetic average surface roughness $Ra_2$ of the recording medium was measured with a surface roughness measuring instrument Surfcorder SE3500 (manufactured by Kosaka Laboratory Ltd.) in accordance with JIS B 0601:2001. The opacity of the recording medium was measured with Technibrite Micro TB1-C (manufactured by Technidyne Corp.) in accordance with JIS P 8149:2000.

TABLE 3

| Structure of Recording Medium | | | | | | | | | |
|---|---|---|---|---|---|---|---|---|---|
| | Polymer-coated substrate | | | | | Ink- | $Ra_2$ of | | |
| Recording medium No. | Polymer-coated substrate No. | Thickness of base paper (μm) | Thickness of polymer layer (μm) | RSm of polymer layer (μm) | $Ra_1$ of polymer layer (mm) | receiving layer Thickness (μm) | surface of recording medium (μm) | ΔRa (μm) = $Ra_1$ − $Ra_2$ | Opacity of recording medium (%) |
| Recording medium 1 | Polymer-coated substrate 1 | 105 | 35 | 0.15 | 0.04 | 35 | 0.11 | 0.04 | 98.7 |
| Recording medium 2 | Polymer-coated substrate 2 | 50 | 35 | 0.18 | 0.04 | 35 | 0.13 | 0.05 | 96.0 |
| Recording medium 3 | Polymer-coated substrate 3 | 90 | 35 | 0.15 | 0.04 | 35 | 0.11 | 0.04 | 98.5 |
| Recording medium 4 | Polymer-coated substrate 4 | 120 | 35 | 0.15 | 0.04 | 35 | 0.11 | 0.04 | 98.8 |
| Recording medium 5 | Polymer-coated substrate 5 | 130 | 35 | 0.14 | 0.04 | 35 | 0.10 | 0.04 | 99.0 |
| Recording medium 6 | Polymer-coated substrate 6 | 105 | 20 | 0.18 | 0.04 | 35 | 0.13 | 0.05 | 98.6 |
| Recording medium 7 | Polymer-coated substrate 7 | 105 | 50 | 0.14 | 0.04 | 35 | 0.11 | 0.03 | 98.8 |
| Recording medium 8 | Polymer-coated substrate 8 | 105 | 60 | 0.13 | 0.04 | 35 | 0.10 | 0.03 | 98.9 |
| Recording medium 9 | Polymer-coated substrate 9 | 105 | 35 | 0.15 | 0.04 | 35 | 0.11 | 0.04 | 95.9 |
| Recording medium 10 | Polymer-coated substrate 10 | 105 | 35 | 0.15 | 0.04 | 35 | 0.11 | 0.04 | 97.0 |
| Recording medium 11 | Polymer-coated substrate 11 | 105 | 60 | 0.13 | 0.04 | 35 | 0.10 | 0.03 | 99.8 |
| Recording medium 12 | Polymer-coated substrate 12 | 105 | 35 | 0.12 | 0.04 | 35 | 0.09 | 0.03 | 98.3 |
| Recording medium 13 | Polymer-coated substrate 13 | 105 | 35 | 0.18 | 0.04 | 35 | 0.13 | 0.05 | 98.9 |
| Recording medium 14 | Polymer-coated substrate 14 | 105 | 35 | 0.15 | 0.01 | 35 | 0.11 | 0.04 | 98.9 |
| Recording medium 15 | Polymer-coated substrate 15 | 105 | 35 | 0.15 | 0.15 | 35 | 0.11 | 0.04 | 98.4 |
| Recording medium 16 | Polymer-coated substrate 16 | 105 | 35 | 0.15 | 0.20 | 35 | 0.12 | 0.03 | 98.2 |
| Recording medium 17 | Polymer-coated substrate 1 | 105 | 35 | 0.15 | 0.04 | 15 | 0.13 | 0.02 | 98.7 |
| Recording medium 18 | Polymer-coated substrate 1 | 105 | 35 | 0.15 | 0.04 | 60 | 0.09 | 0.06 | 98.8 |
| Recording medium 19 | Polymer-coated substrate 17 | 40 | 35 | 0.19 | 0.04 | 35 | 0.15 | 0.04 | 92.0 |
| Recording medium 20 | Polymer-coated substrate 18 | 140 | 35 | 0.14 | 0.04 | 35 | 0.11 | 0.03 | 99.5 |
| Recording medium 21 | Polymer-coated substrate 19 | 105 | 15 | 0.19 | 0.04 | 35 | 0.15 | 0.04 | 98.8 |
| Recording medium 22 | Polymer-coated substrate 20 | 105 | 65 | 0.13 | 0.04 | 35 | 0.10 | 0.03 | 98.7 |
| Recording medium 23 | Polymer-coated substrate 21 | 105 | 35 | 0.11 | 0.04 | 35 | 0.11 | 0 | 98.3 |
| Recording medium 24 | Polymer-coated substrate 22 | 105 | 35 | 0.15 | 0.001 | 35 | 0.11 | 0.04 | 99.0 |
| Recording medium 25 | Polymer-coated substrate 23 | 105 | 35 | 0.15 | 0.30 | 35 | 0.14 | 0.01 | 98.1 |
| Recording medium 26 | Polymer-coated substrate 1 | 105 | 35 | 0.15 | 0.04 | 10 | 0.14 | 0.01 | 98.7 |
| Recording medium 27 | Polymer-coated substrate 24 | 105 | 35 | 0.11 | 0.40 | 35 | 0.11 | 0 | 98.0 |

[Evaluation of Recording Medium]

In the following evaluation items, criteria AA to B are acceptable, and criteria C and D are unacceptable. Images were recorded on a recording medium with an ink jet recording apparatus PIXUS MP990 (manufactured by CANON KABUSHIKI KAISHA) equipped with an ink cartridge BCI-321 (manufactured by CANON KABUSHIKI KAISHA). The recording conditions included a temperature of 23° C. and a relative humidity of 50%. A print duty of 100% with respect to the ink jet recording apparatus refers to an image that was recorded under the conditions where approximately 11 ng of one ink droplet was applied to a unit area of 1/600 inches×1/600 inches at a resolution of 600 dpi×600 dpi.

Feel of Image

Portraits and landscapes were recorded on a recording medium with the ink jet recording apparatus in a Photo Paper Pro Platinum mode (with color correction). The feel of each image was visually evaluated. The evaluation criteria were described below. Table 4 shows the evaluation results.

AA: The images had the feel of silver halide photography and were of good quality.

A: The images substantially had the feel of silver halide photography and were of substantially good quality.

B: The images had a feel slightly inferior to the feel of silver halide photography but were of substantially good quality.

C: The images had a feel slightly inferior to the feel of silver halide photography and were of moderate quality.

D: The images lacked the feel of silver halide photography and were of poor quality.

Turnability of Recording Medium

Twenty A4-size recording media were used to make a photo album. The photo album was turned to evaluate turnability of the recording media. The evaluation criteria were as described below. Table 4 shows the evaluation results.

AA: The turnability was excellent.

A: The turnability was good.

B: The turnability was slightly poor.

C: The turnability was poor.

Opacity of Recording Medium for Preventing Image on Back Side from being Seen Through Front Side Portraits and landscapes were recorded on both sides of a recording medium with the ink jet recording apparatus in a Photo Paper Pro Platinum mode (with color correction). The front side of the recording medium was visually inspected for an image on the back side. The evaluation criteria were as described below. Table 4 shows the evaluation results.

AA: An image on the back side could not be seen from the front side.

A: An image on the back side could rarely be seen from the front side.

B: Although an image on the back side was slightly visible from the front side, it was not noticeable.

C: An image on the back side was clearly visible from the front side.

TABLE 4

| Evaluation result | | | | | |
|---|---|---|---|---|---|
| | | Evaluation of | Evaluation of recording medium | | |
| Example No. | Recording medium No. | substrate Winding of substrate | Feel of image | Turnability of recording medium | Opacity of recording medium |
| Example 1 | Recording medium 1 | A | AA | AA | AA |
| Example 2 | Recording medium 2 | A | B | A | B |
| Example 3 | Recording medium 3 | A | AA | AA | AA |
| Example 4 | Recording medium 4 | A | AA | AA | AA |
| Example 5 | Recording medium 5 | A | AA | A | AA |
| Example 6 | Recording medium 6 | A | B | AA | AA |
| Example 7 | Recording medium 7 | A | AA | AA | AA |
| Example 8 | Recording medium 8 | A | AA | B | AA |
| Example 9 | Recording medium 9 | A | AA | AA | B |
| Example 10 | Recording medium 10 | A | AA | AA | B |
| Example 11 | Recording medium 11 | A | AA | B | AA |
| Example 12 | Recording medium 12 | B | AA | AA | A |
| Example 13 | Recording medium 13 | A | B | AA | AA |
| Example 14 | Recording medium 14 | B | AA | AA | AA |
| Example 15 | Recording medium 15 | A | A | AA | A |
| Example 16 | Recording medium 16 | B | B | AA | A |
| Example 17 | Recording medium 17 | A | B | AA | AA |
| Example 18 | Recording medium 18 | A | AA | B | AA |
| Comparative example 1 | Recording medium 19 | A | D | C | C |
| Comparative example 2 | Recording medium 20 | A | AA | C | AA |
| Comparative example 3 | Recording medium 21 | A | D | AA | AA |
| Comparative example 4 | Recording medium 22 | A | AA | C | AA |
| Comparative example 5 | Recording medium 23 | D | AA | AA | A |
| Comparative example 6 | Recording medium 24 | C | AA | AA | AA |
| Comparative example 7 | Recording medium 25 | C | C | AA | A |
| Comparative example 8 | Recording medium 26 | A | C | AA | AA |
| Comparative example 9 | Recording medium 27 | D | AA | AA | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-145661, filed Jun. 28, 2012, which is hereby incorporated by reference herein in its entirety.

What is claimed is:

1. A recording medium comprising:

a base paper;

a polymer layer disposed on the base paper; and an ink-receiving layer disposed on the polymer layer, wherein the base paper has a thickness of 50 μm or more and 130 μm or less, the polymer layer has a thickness of 20 μm or more and 60 μm or less, the polymer layer has an arithmetic average surface roughness $Ra_1$ of 0.12 μm or more and 0.18 μm or less in accordance with JIS B 0601:2001, the polymer layer has a roughness curve element average length RSm of 0.01 mm or more and 0.20 mm or less in accordance with JIS B 0601:2001, and the recording medium has an arithmetic average surface roughness $Ra_2$ of 0.13 μm or less in accordance with JIS B 0601:2001.

2. The recording medium according to claim 1, wherein the difference $\Delta Ra$ ($Ra_1 - Ra_2$) between the arithmetic average surface roughness $Ra_1$ of the polymer layer and the arithmetic average surface roughness $Ra_2$ of the recording medium is 0.03 μm or more and 0.05 μm or less.

3. The recording medium according to claim 1, wherein the polymer layer contains a white pigment, and the white pigment content is 3 $g/m^2$ or more and 30 $g/m^2$ or less.

4. The recording medium according to claim 1, wherein the recording medium has an opacity of 97% or more in accordance with JIS P 8149:2000.

5. The recording medium according to claim 1, further comprising a second ink-receiving layer on a surface of the base paper opposite the polymer layer.

6. The recording medium according to claim 5, further comprising a second polymer layer between the base paper and the second ink-receiving layer.

* * * * *